US011479884B2

(12) United States Patent
Nasri et al.

(10) Patent No.: US 11,479,884 B2
(45) Date of Patent: Oct. 25, 2022

(54) DEVICE AND METHOD FOR PRODUCING A MULTICOLOR YARN

(71) Applicant: Truetzschler GmbH & Co. KG., Moenchengladbach (DE)

(72) Inventors: Lassad Nasri, Winterthur (CH); Nuri Kosar, Atatürk Mah. (TR)

(73) Assignee: Trützschler Group SE, Mönchengladbach (DE)

( * ) Notice: Subject to any disclaimer, the term of this patent is extended or adjusted under 35 U.S.C. 154(b) by 601 days.

(21) Appl. No.: 16/477,462

(22) PCT Filed: Jan. 11, 2018

(86) PCT No.: PCT/EP2018/050641
§ 371 (c)(1),
(2) Date: Jul. 11, 2019

(87) PCT Pub. No.: WO2018/130608
PCT Pub. Date: Jul. 19, 2018

(65) Prior Publication Data

US 2019/0360129 A1 Nov. 28, 2019

(30) Foreign Application Priority Data

Jan. 12, 2017 (DE) ..... 102017100487.4

(51) Int. Cl.
*D02J 1/08* (2006.01)
*D02J 13/00* (2006.01)
(Continued)

(52) U.S. Cl.
CPC ..... *D02G 1/20* (2013.01); *D02G 1/168* (2013.01); *D02J 1/08* (2013.01); *D02J 1/224* (2013.01); *D02J 13/005* (2013.01)

(58) Field of Classification Search
CPC . D02J 1/08; D02J 13/005; D02J 11/00; D02G 1/168; D02G 1/16; D02G 1/20
See application file for complete search history.

(56) References Cited

U.S. PATENT DOCUMENTS 3,671,623 A * 6/1972 Fukushima ..... D02J 1/22 28/246
4,035,879 A * 7/1977 Schippers ..... D02J 1/224 28/246

(Continued)

FOREIGN PATENT DOCUMENTS

| | | | |
|---|---|---|---|
| DE | 10236359 | A1 | 2/2004 |
| EP | 0784109 | B1 | 9/2002 |
| JP | 2006-097177 | A | 4/2006 |

OTHER PUBLICATIONS

International Search Report for PCT/EP2018/050641 dated Feb. 23, 2018.
Written Opinion for PCT/EP2018/050641 dated Feb. 23, 2018.

*Primary Examiner* — Jillian K Pierorazio
(74) *Attorney, Agent, or Firm* — FisherBroyles, LLP; Robert Kinberg

(57) ABSTRACT

A draw device into which at least two filaments are guided for producing a multi-coloured yarn from differently coloured filaments which consist of a plurality of endless filaments includes a pair of intake rollers for receiving the at least two filaments. Two pairs of drafting system rollers follow the intake rollers to draw the at least two filaments. A texturizing device comprising a texturizing nozzle with a cooling drum is disposed downstream of the two pairs of drafting system rollers to texturize the at least two filaments, wherein at least one yarn is formed from the filaments in the texturizing nozzle. At least one further nozzle is disposed exclusively upstream of the texturizing device in which each filament is separately interlaced. The filaments are drawn on (Continued)

at least one of the two pairs of drafting system rollers at a speed of at least 1,700 m/min.

14 Claims, 3 Drawing Sheets

(51) Int. Cl.
*D02G 1/20* (2006.01)
*D02G 1/16* (2006.01)
*D02J 1/22* (2006.01)

(56) References Cited

U.S. PATENT DOCUMENTS 5,558,825 A * 9/1996 Ueda ..... D01D 10/02 264/235.6
5,664,307 A * 9/1997 Stitz ..... D02J 1/224 28/241
5,698,146 A * 12/1997 Schippers ..... D02J 13/00 425/464
5,783,127 A * 7/1998 Gross ..... D02J 13/005 264/211.17
5,804,115 A * 9/1998 Burton ..... D02G 1/168 28/220
6,013,223 A * 1/2000 Schwarz ..... D01D 5/0985 425/464
6,055,712 A * 5/2000 Thoma ..... D02G 1/161 28/258
6,105,224 A * 8/2000 O'Mara, Jr. ..... D02G 3/406 28/247
6,722,117 B2 * 4/2004 Belcher, Jr. ..... D02G 1/20 57/244
2001/0038159 A1 * 11/2001 Maranca ..... D02G 1/122 28/258
2002/0121011 A1 * 9/2002 Rasnick, Jr. ..... D02G 1/20 28/258
2005/0022492 A1 * 2/2005 Antouly ..... D02G 3/285 57/58.49
2005/0147784 A1 * 7/2005 Chang ..... D02G 1/20 264/168
2005/0278913 A1 * 12/2005 Grassi ..... D02J 1/08 57/256
2007/0222104 A1 * 9/2007 Sukuzi ..... D02J 1/224 425/66
2008/0041030 A1 * 2/2008 Stundl ..... D02G 1/20 57/287
2009/0068463 A1 * 3/2009 Mochizuki ..... D01F 8/12 264/168
2012/0130024 A1 * 5/2012 Sato ..... D02J 1/228 525/450
2015/0218733 A1 * 8/2015 Stundl ..... D02J 1/22 264/103
2017/0037542 A1 * 2/2017 Chen ..... D01D 5/24

* cited by examiner

DEVICE AND METHOD FOR PRODUCING A MULTICOLOR YARN

CROSS-REFERENCE TO RELATED APPLICATIONS

This application is a U.S. National Stage Application of International Patent Application No. PCT/EP2018/050641, filed Jan. 11, 2018, which claims benefit of German Patent Application No. 10 2017 100 487.4, filed Jan. 12, 2017.

BACKGROUND OF THE INVENTION

The present invention relates to a device and to a method for producing a multi-coloured yarn from differently coloured filaments, which respectively consist of a plurality of endless filaments, wherein at least two filaments are guided into a draw device, are guided there by means of a pair of intake rollers towards at least two pairs of drafting system rollers, and are drawn by the same, a texturizing device with a cooling drum being disposed downstream therefrom.

For manufacturing textile goods, in particular area rugs and upholstery, coloured yarns are produced by blending several thread bundles of different colours. In order to produce an end product having a distinct colour effect, the individual endless filaments need to be combined with each other so that to a unique colour separation is recognizable. Usually, this is realized by tangling, in that the threads are interlaced with each other by means of lateral compressed air admission. Subsequently, crimping is realized in the stuffer box of a texturizing nozzle.

In order to prevent the colours from blending, namely to achieve a high colour distinction, respectively colour separation, in the state-of-the-art tangling is employed after the spin-draw process and after the texturizing, because the deformation of the complete strand is not at all desired, but the deformation of the individual filaments. In this case, it is assumed that tangling prior to drawing and texturizing will result in bonding of the filaments or in considerable sticking to each other, which necessarily results in blending of colours or indistinct dissociation of colours. Thereby, an installation for processing six or nine filaments becomes very expensive, because the texturizing nozzle likewise must comprise six or nine channels, and the cooling drum, the drafting system rollers and the deflections including bearings and temperature control need to be dimensioned correspondingly in order to guide the six, respectively nine filaments at a distance from each other.

The document EP 0 784 109 B1 describes a method for manufacturing a yarn having a plurality of differently coloured filament bundles. In this case, at least one filament bundle is treated individually upstream the connecting step and downstream all preceding drawing and texturizing procedures.

SUMMARY OF THE INVENTION

The object of the invention consists in the further development of a known device and of a method with the result of simplifying the device and the method for manufacturing the multi-coloured yarns and of manufacturing an end product having a distinct colour effect.

This object is achieved with a device according to the generic part of claim 1 in conjunction with the characterizing features. Advantageous further developments of the invention are indicated in the dependent claims.

The invention includes the technical teaching that for producing a multi-coloured yarn from differently coloured filaments, which consist of a plurality of endless filaments, at least two filaments are guided into a draw device, are guided there by means of a pair of intake rollers towards at least two pairs of drafting system rollers, and are drawn by the same, a texturizing device with a cooling drum being disposed downstream therefrom.

The invention is characterized in that a nozzle for interlacing the filaments, which consist of a plurality of endless filaments, is disposed upstream the texturizing device. In this case, each filament is separately interlaced in the nozzle. Converging the filaments to a yarn is realized in the texturizing nozzle. Surprisingly, unlike the general opinion of the individuals skilled in the art, the short detention time in the nozzle has proven to allow for preventing bonding and connecting of the filaments during the following texturizing, such as to be able to achieve a very high colour distinction.

In a first embodiment, the nozzle for interlacing the filaments is disposed downstream the two-staged drawing and upstream the texturizing nozzle. In this case, the pair of drafting system rollers upstream the nozzle has the highest speed in the draw device, at which the filaments are conveyed. Thereby, a minimum detention time may be achieved in the nozzle, which prevents blending of the colours on account of potentially connecting filaments to each other. In this case, the speed of the filaments on said drafting system rollers amounts to at least 1,700 m/min.

In order to obtain a uniform heating of the filaments, the drafting system rollers are configured as heated duo rolls.

With further advantage, the filaments, which consist of a plurality of endless filaments, are respectively separately interlaced by means of a nozzle prior to drawing. Said first interlacing allows for further improving the following process of the second interlacing, because it stabilizes the texture of the individual filaments.

Basically, the nozzles for tanglelacing and interlacing may be operated at a pressure (overpressure) of 0.01 to 12 bars, wherein a gaseous medium, preferably air is laterally introduced into the nozzle and results in the tanglelacing, respectively the interlacing of the filaments. The best results have been achieved for both nozzles, if the pressure amounts to between 0.01 to 6 bars. This achieved the highest colour distinction.

In the second embodiment, the nozzle for interlacing the filaments is disposed downstream the pair of intake rollers and upstream the drafting system rollers. According to the prevailing opinion, the colour distinction of the yarn would decrease with a following drawing and texturizing, because the individual filaments may bond to each other in the further process. In this case, a very short detention time of the filaments in the nozzle allowed for preventing subsequent bonding and connecting of the filaments such as to likewise demonstrate the desired colour distinction.

Advantageously, in all exemplary embodiments, drafting system rollers are employed downstream the texturizing device, which cool the yarn to a temperature of 0° C. to 80° C., preferably to a temperature of 0° C. to 50° C. This is advantageous for a further fixation of the yarns stuffed in the texturizing nozzle, but also for making the colour distinction clearly evident prior to reeling the yarn on the lapper.

The inventive method according to claim 10 achieves the object in that at least two filaments are guided in a draw device, are guided there by means of a pair of intake rollers to at least two pairs of drafting system rollers and are drawn by the same, are subsequently texturized, and cooled on a cooling drum (9). The inventive method is characterized in that, prior to texturizing, the filaments, which consist of a plurality of endless filaments, are respectively separately interlaced. Subsequently converging the filaments to a yarn is realized in the texturing nozzle.

Based on the very short detention time of the filaments during interlacing in the nozzle, surprisingly bonding and connecting the filaments during the subsequent tanglelacing may be prevented, such as to be able to achieve a very high colour distinction.

In a first embodiment, tanglelacing of the filaments to a yarn in the texturizing nozzle is realized after a two-staged drawing. As the speed of the filaments in the draw device is the highest on the second pair of drafting system rollers, the short detention time in the nozzle, in which the filaments are respectively individually interlaced, results in the filaments not blending or partially fusing during the following texturizing, which considerably improves the colour distinction of the yarn. Advantageously in this case, the speed of the filaments amounts to at least 1,700 m/min.

Preferably, an enhancement of the effect is achieved in that the filaments, which consist of a plurality of individual filaments, are separately interlaced prior to drawing. Thereby, each interlaced filament has a more stable texture, which has a positive effect on the colour distinction during the subsequent texturizing and tanglelacing.

In a second embodiment, the interlacing of the filaments is realized prior to drawing. Here again, the short detention time in the nozzle contributes to the filaments not having a tendency to bonding in the texturizing nozzle during the further processing.

Preferably, in both embodiments, texturizing is followed by a drawing, respectively relaxing the yarn by drafting system rollers, which cool the yarn to a temperature of 0° C. to 80° C., preferably to a temperature of 0° C. to 50° C. Thereby, the yarn, which has puffed up in the texturizing nozzle, allows for being easy to fix, without diminishing the colour distinction.

BRIEF DESCRIPTION OF THE DRAWINGS

Further measures enhancing the invention will be illustrated in more detail in the following in conjunction with the description of one preferred exemplary embodiment of the invention based on the Figures. It shows.

DETAILED DESCRIPTION OF THE INVENTION

Figure 1:
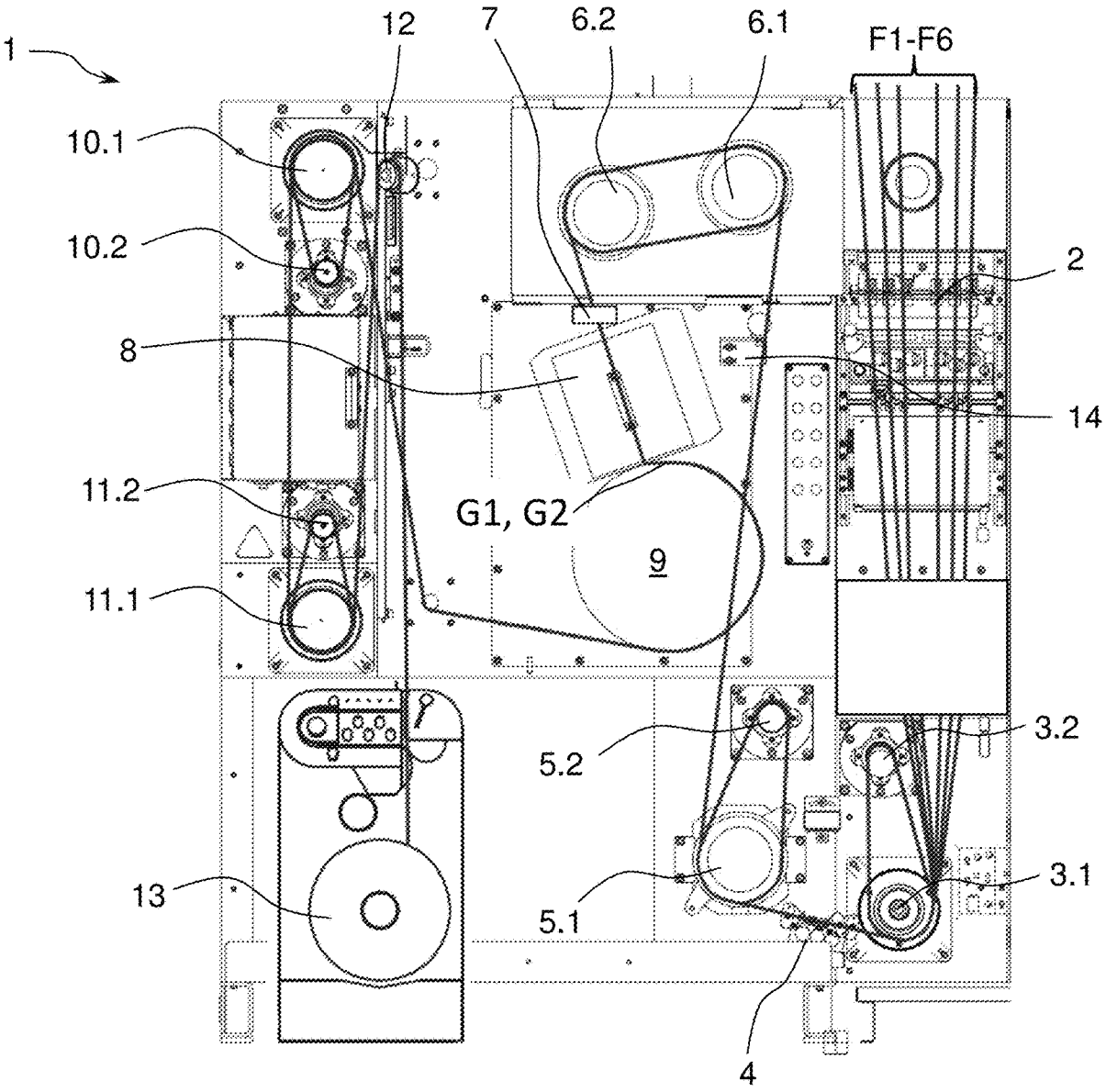
FIG. 1: a partial illustration of a first exemplary embodiment of a spin-draw installation.

FIG. 1 shows a section of a spin-draw installation according to a first exemplary embodiment, in which six differently coloured filaments F1 to F6, for example made from polyamide 6 (PA6), enter the draw device 1 from non-illustrated spinning nozzles. Basically, said type of installation allows for processing of up to twelve filaments, wherein said exemplary embodiment describes the processing of six filaments. The colouration of the filaments F1 to F6 is realized via different batches of plastic materials, which are separately extruded and respectively transformed to an endless filament by means of a spinning head. Each filament F1 to F6 consists respectively of up to 1000 endless filaments, which are combined to respectively one filament F1 to F6 downstream the spinning head upstream the draw device 1. The filaments F1 to F6 enter the draw device 1 with a speed of 925 m/min, and, in a preparation device 2, they are treated with oil or a sliding agent, and are rerouted to a first pair of drafting system rollers 5.1, 5.2 via a pair of intake rollers 3.1, 3.2.

Optionally, a first nozzle 4, in which the six filaments F1 to F6 are laterally charged with a gaseous medium, preferably air, at a pressure of 0.01 to 12 bar, may be disposed between the pair of intake rollers 3.1, 3.2 and the pair of drafting rollers 5.1, 5.2. The nozzle 4 includes a separate guide for each filament F1 to F6 so that the filaments F1 to F6 do not get in contact with each other. Up to 1000 endless filaments are interlaced with each other within the guide of the nozzle 4 so that six separately interlaced filaments F1 to F6 exit from the nozzle 4, and are guided onto the pair of drafting system rollers 5.1, 5.2.

At a speed of 925 m/min, the filaments F1 to F6 are heated to a temperature of 65° C. at the pair of drafting system rollers 5.1, 5.2. Said pair of drafting system rollers 5.1, 5.2 is configured as a mono roller, in which just the drafting system roller 5.1 is driven. The drafting system roller 5.2 is not driven, but rotates along due to the tension of the filaments F1 to F6. Also, the drafting system rollers 5.1, 5.2 may be configured as duo rollers, in which both rollers are driven, and which essentially have a same sized exterior diameter. This is advantageous in that the gradual heating of the filaments F1 to F6 may be realized more continuously over a longer period of time, which is advantageous for transforming the molecule chains. In this case, the surfaces of the pairs of drafting system rollers may be heated by means of a non-illustrated heating system, for example an electrical, vapour-based or liquid-based heating system, wherein in the following, it is assumed that during the at least double circulation around the pairs of draw rollers, the filaments F1 to F6 have also taken on the temperature of the pairs of draw rollers.

The filaments F1 to F6 are guided from the pair of rollers 5.1, 5.2 to the pair drafting rollers 6.1, 6.2, wherein previously they are kept at a distance from each other by means of a guide 14. The further drawing and heating on the pair of drafting rollers 6.1, 6.2, which are configured as duo, is realized at a speed of 2,500 m/min and a heating to 170° C.

The nozzle 7 likewise includes a separate guide for each filament F1 to F6 so that the filaments F1 to F6 do not get in contact with each other. The up to 1000 endless filaments are interlaced with each other within the guide of the nozzle 7 so that six separately interlaced filaments F1 to F6 exit from the nozzle 7 and enter the texturizing nozzle. Within the nozzle 7, the six filaments F1 to F6 are interlaced by means of a blown-in gaseous medium, preferably air, at a pressure of 0.01 to 12 bars. The formation of the yarns G1, G2 is realized in the texturizing nozzle 8, wherein altogether two crimped yarns G1, G2 are created in the texturizing nozzle 8, which respectively consist of three filaments F1 to F3 and F4 to F6 having respectively one colour per filament. Thereby, each yarn G1, G2 may include three filaments having three different colours, which are clearly distinguished from each other. However, depending on the configuration of the installation, each yarn G1, G2 may consist of two or four filaments having a different colour.

The advantage of the invention in this embodiment consists in the fact that the yarn G1, G2 having the three filaments clearly indicates the colours of the filaments without causing any blending. According to the state-of-the-art this would not be possible, because the individual filaments F1 to F3 and F4 to F6 would bond to each other, which would result in an indistinct dissociation of the colours. In contrast to the state-of-the-art, surprisingly it has proven that with an extremely short detention time within the nozzle 7, the subsequent bonding of the filaments F1 to F3 and F4 to F6 may be prevented in the texturizing nozzle. As the speed of the filaments F1 to F6 in the entire draw device 1 is the highest with the drafting system rollers 6.1, 6.2, simultaneously, the detention time of the filaments F1 to F6 is the shortest in the downstream disposed nozzle 7. With a speed of the filaments F1 to F6 around the drafting system rollers 6.1, 6.2 of 2,500 m/min for PA6, the detention time of the filaments F1 to F6 in the nozzle 7 amounts to just about 5 milliseconds.

The parameters for the drafting system rollers 6.1, 6.2 may be the following with other plastic materials:

| Parameter for | | Unit | PP | PA6 | PET | PA6-6 |
|---|---|---|---|---|---|---|
| drafting system rollers 6.1, 6.2 | speed | m/min | 2030 | 2500 | 3200 | 2960 |
| | temperature | ° C. | 130 | 170 | 165 | 200 |

Advantageously, now just two yarns G1, G2 are texturized and further drawn, which makes the installation more compact and less expensive, than if six, respectively up to twelve filaments would be processed. The downstream drafting system rollers may be configured to be shorter, which simplifies the temperature control and the bearings.

After the nozzle 7, the filaments F1 to F6 enter the downstream disposed texturizing nozzle 8, in which they converge to the yarn G1 and G2, whereby the texturizing nozzle 8 just needs to be provided with two nozzle channels. Here, two crimped yarns G1, G2 are produced at a temperature of 180° C., the texture thereof being frozen on the downstream cooling drum 9. Then, after the nozzle 7, the filaments F1 to F6 are heated again in the texturizing nozzle 8, for PA6 from 170° C. to 180° C.

A subsequent light drawing is realized with cold drafting system rollers 10.1, 10.2 and 11.1, 11.2. On the drafting system roller 10.1, the speed of the yarn amounts to 2,222 m/min. The drafting system roller 11.1 transports the yarn G1, G2 with a speed of 2.257 m/min at a temperature of 20° C. to 80° C., for example. Preferably, the drafting system rollers 10.1, 10.2, 11.1, 11.2 may be cooled.

During a final deflection by means of the deflector 12 towards the lapper 13, the yarn G1, G2 is wound onto two coils at a speed of 2201 m/min.

This installation is advantageous in that an existing installation with six, respectively with up to twelve entering filaments just needs one texturizing nozzle 8 with two, respectively with up to four channels, such that subsequently the drawing with the drafting system rollers 10.1, 10.2, 11.1, 11.2 may be build shorter.

Figure 3:
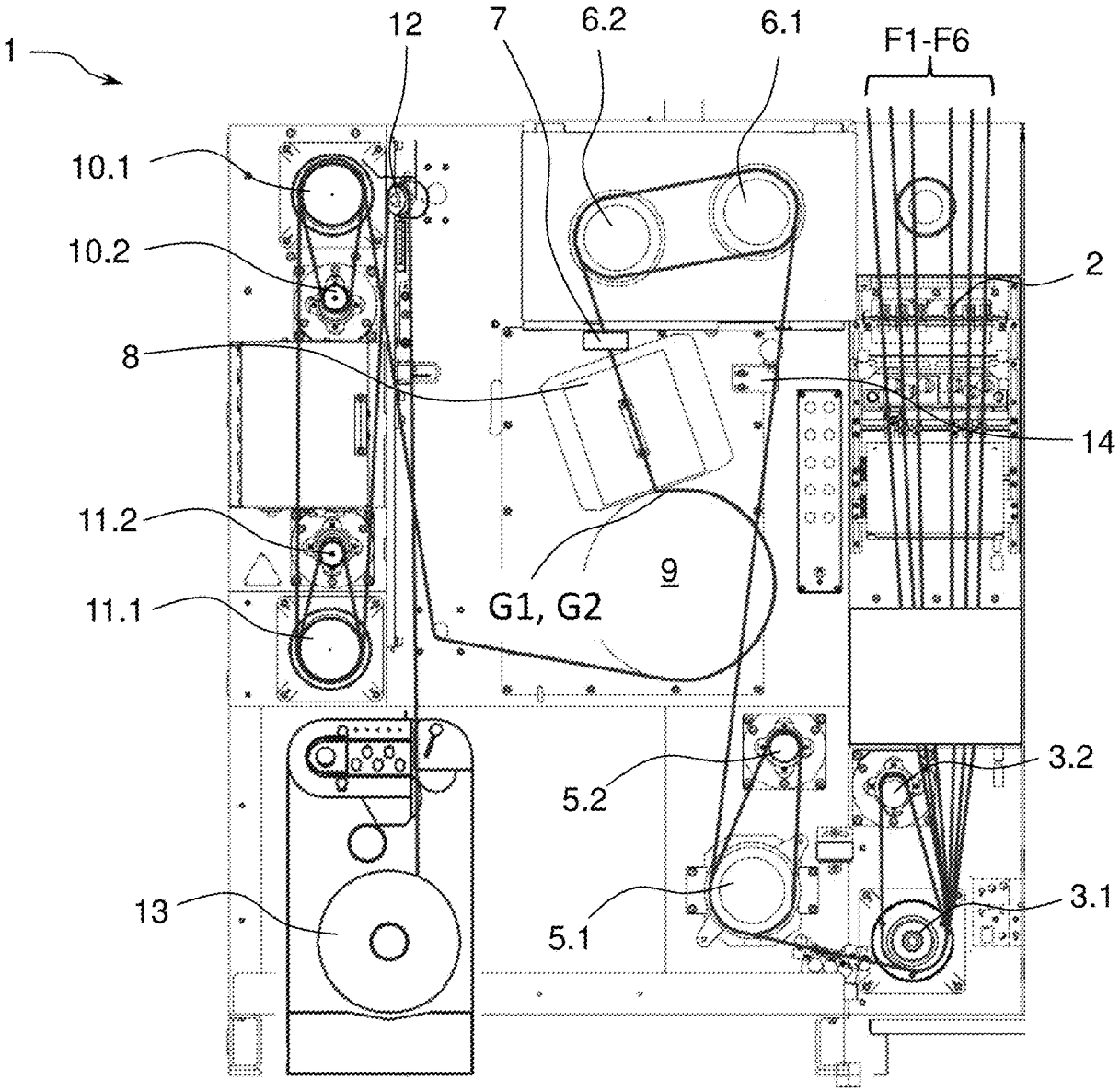
FIG. 3: a partial illustration of a third exemplary embodiment of a spin-draw installation.

In comparison to the exemplary embodiment of FIG. 3, the nozzle 4 may be optionally employed. The method for separately interlacing the filaments F1 to F6 in the nozzle 7 and combining them to yarns G1, G2 in the texturizing nozzle 8 may be also employed without the nozzle 4 (FIG. 3), and achieves good results. The utilization of the nozzle 4 for interlacing the individual filaments F1 to F6 is advantageous in that the texture of each individual filament F1 to F6 is more stable, which positively influences on the following interlacing in the nozzle 7. With the nozzle 4, which effects an interlacing of the up to 1000 endless filaments of each filament F1 to F6, the colour separation becomes even clearer after interlacing in the nozzle 7.

Figure 2:
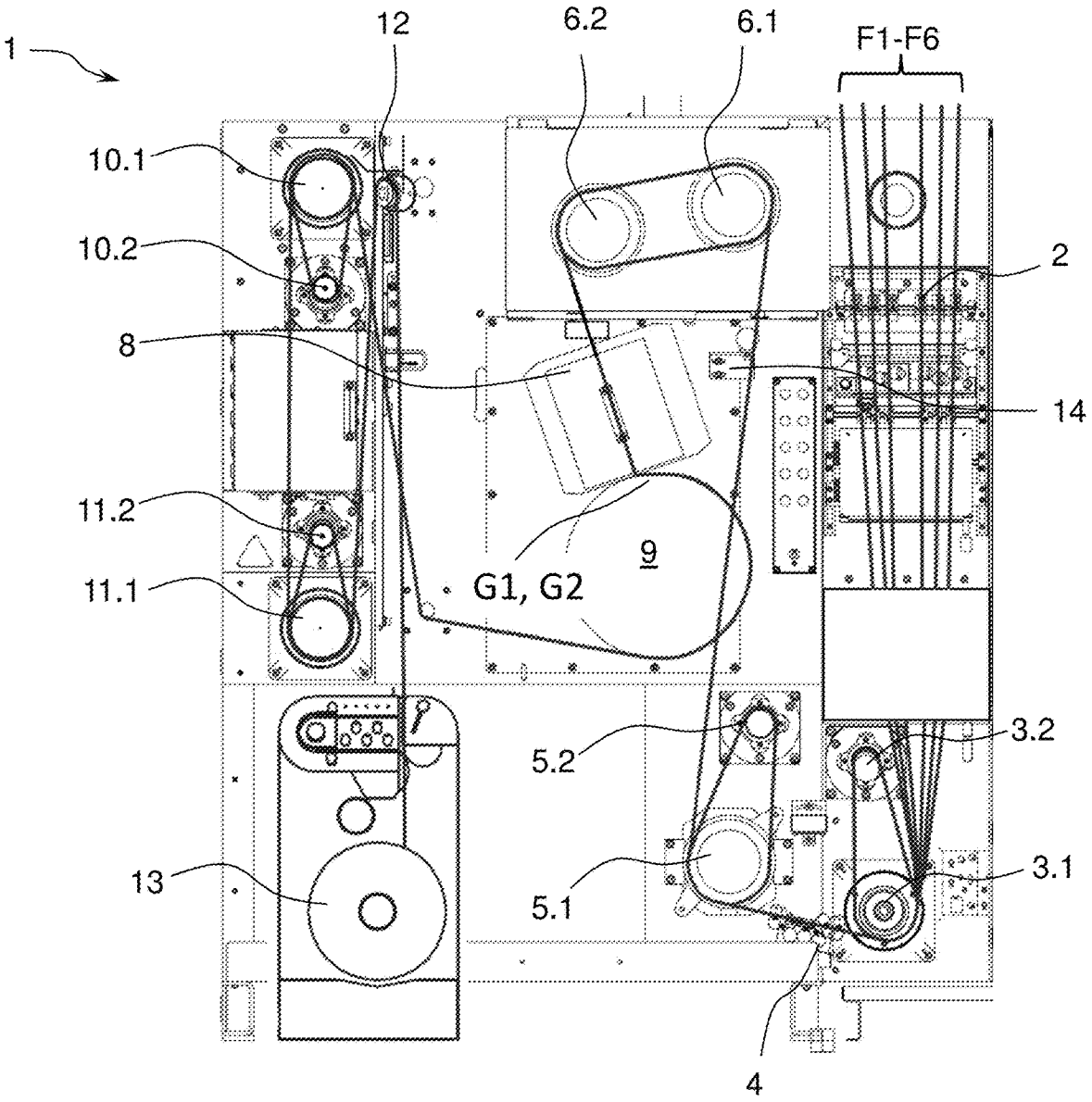
FIG. 2: a partial illustration of a second exemplary embodiment of a spin-draw installation.

In a second exemplary embodiment according to FIG. 2, for example the six filaments F1 to F6 are separately interlaced by utilizing the nozzle 4 between the pair of intake rollers 3.1, 3.2 and the drafting system rollers 5.1, 5.2. Based on the short detention time of the filaments F1 to F6 in the nozzle 4, a separate interlacing may be realized such that also in the yarns G1, G2, which are subsequently produced from the six filaments F1 to F6 in the texturizing nozzle 8, a clear colour separation is achieved. The further processing of the filaments F1 to F6 is realized according to the exemplary embodiment 1, however, without the nozzle 7. This configuration is advantageous in that the separately interlaced filaments F1 to F6 may be guided from the nozzle 4 on in an easier and more stable manner through the entire installation. Also according to this exemplary embodiment, due to a very short detention time of the filaments F1 to F6 in the nozzle 4, the colour separation may be maintained. In this case, the detention time of the plastic material of the filaments F1 to F6 in the nozzle 7 amounts to about 10 milliseconds.

In the exemplary embodiment of FIG. 3, the filaments (F1 to F6) are exclusively interlaced with the nozzle 7 upstream the texturizing nozzle 8, and respectively three filaments F1 to F3 and F4 to F6 are connected to each other to one yarn G1, G2 in the texturizing nozzle 8. Otherwise, the exemplary embodiment is identical to the exemplary embodiment of FIG. 1.

According to FIG. 3, six differently coloured filaments F1 to F6, for example made from polyamide 6 (PA6), enter the draw device 1 from non-illustrated spinning nozzles. The colouration of the filaments F1 to F6 is realized by different batches of plastic materials, which are separately extruded and respectively transformed into an endless filament by means of a spinning head. Each filament F1 to F6 consists respectively of up to 1000 endless filaments, which are united to respectively one filament F1 to F6 downstream the spinning head upstream the draw device 1. The filaments F1 to F6 enter the draw device 1 with a speed of 925 m/min, and, in a preparation device 2, they are treated with oil or a sliding agent, and are rerouted to a first pair of drafting system rollers 5.1, 5.2 via a pair of intake rollers 3.1, 3.2. At a speed of 925 m/min, the filaments F1 to F6 are heated to a temperature of 65° C. at the pair of drafting system rollers 5.1, 5.2. Said pair of drafting system rollers 5.1, 5.2 is configured as a mono roller, in which just the drafting system roller 5.1 is driven. The filaments F1 to F6 are guided from the pair of drafting rollers 5.1, 5.2 to the pair of drafting rollers 6.1, 6.2, wherein previously they are kept at a distance from each other by means of a guide 14. The further drawing and heating on the pair of drafting rollers 6.1, 6.2, which are configured as duo, is realized at a speed of 2,500 m/min and a heating to 170° C.

The nozzle 7 likewise includes a separate guide for each filament F1 to F6 so that the filaments F1 to F6 do not get in contact with each other. The up to 1000 endless filaments are interlaced with each other within the guide of the nozzle 7 so that six separately interlaced filaments F1 to F6 exit from the nozzle 7 and enter the texturizing nozzle. Within the nozzle 7, the six filaments F1 to F6 are interlaced with each other by means of a blown-in gaseous medium, preferably air, at a pressure of 0.01 to 12 bars. The formation of the yarns G1, G2 is realized in the texturizing nozzle 8, wherein altogether two crimped yarns G1, G2 are created in the texturizing nozzle 8, which respectively consist of three filaments F1 to F3 and F4 to F6 having respectively one colour per filament. Thereby, each yarn G1, G2 may include three filaments having three different colours, which are clearly distinguished from each other. However, depending on the configuration of the installation, each yarn G1, G2 may consist of two or four filaments varying in colour.

The advantage of the invention in this embodiment consists in the fact that the yarn G1, G2 having the three filaments clearly indicates the colours of the filaments without any blending occurring. According to the state-of-the-art this would not be possible, because the individual filaments F1 to F3 and F4 to F6 would bond to each other, which would result in a non-distinct dissociation of the colours. In contrast to the state-of-the-art, surprisingly, it has proven that with an extremely short detention time within the nozzle 7, the subsequent bonding of the filaments F1 to F3 and F4 to F6 may be prevented. As the speed of the filaments F1 to F6 in the entire draw device 1 is the highest with the drafting system rollers 6.1, 6.2, simultaneously, the detention time of the filaments F1 to F6 is shortest in the downstream disposed nozzle 7. With a speed of the filaments F1 to F6 around the drafting system rollers 6.1, 6.2 of 2,500 m/min for PA6, the detention time of the filaments F1 to F6 in the nozzle 7 amounts to just about 5 milliseconds.

The parameters for the drafting system rollers 6.1, 6.2 may be the following with other plastic materials:

| Parameter for | | Unit | PP | PA6 | PET | PA6-6 |
|---|---|---|---|---|---|---|
| drafting system rollers 6.1, 6.2 | speed | m/min | 2030 | 2500 | 3200 | 2960 |
| | temperature | ° C. | 130 | 170 | 165 | 200 |

Advantageously, now just two yarns G1, G2 are texturized and further drawn, which makes the installation more compact and less expensive, than if six, respectively up to twelve filaments would be processed. The downstream drafting system rollers may be configured to be shorter, which simplifies the temperature control and the bearings.

After the nozzle 7, the filaments F1 to F6 enter the downstream disposed texturizing nozzle 8, in which they converge to the crimped yarn G1 and G2, whereby the texturizing nozzle 8 just needs to be provided with two nozzle channels. Here, at a temperature of 180° C. are produced from the filaments two crimped yarns G1, G2, the texture thereof being frozen on the downstream cooling drum 9. Then, after the nozzle 7, the filaments F1 to F6 are heated again in the texturizing nozzle 8, for PA6 from 170° C. to 180° C.

A following light drawing is realized with cold drafting system rollers 10.1, 10.2 and 11.1, 11.2. On the drafting system roller 10.1, the speed of the yarn amounts to 2,222 m/min. The drafting system roller 11.1 transports the yarn G1, G2 with a speed of 2.257 m/min at a temperature of 20° C. to 80° C. Preferably, the drafting system rollers 10.1, 10.2, 11.1, 11.2 are cooled.

During a final deflection by means of the deflector 12 towards the lapper 13, the yarn G1, G2 is wound onto two coils at a speed of 2201 m/min.

This installation is advantageous in that an existing installation with six, respectively with up to twelve entering filaments just needs one texturizing nozzle 8 with two, respectively with up to four channels, such that subsequently the drawing with the drafting system rollers 10.1, 10.2, 11.1, 11.2 may be build to be shorter.

Altogether up to 12 filaments (F1 to F12) of different colours having respectively up to 1000 endless filaments may be processed in the installation, such as to be able produce up to four yarns (G1 . . . G4), wherein each yarn may consist of two, three or four filaments varying in colour.

The invention may be employed with all types of polymers, such as for example PP, PET, PA6, PA6.6 or PBT.

The invention in the embodiment thereof is not limited to the above-indicated preferred exemplary embodiment. Rather, a number of variants is conceivable, which utilize the illustrated solution, even though basically the embodiments may be different. All the features and/or advantages including constructional particularities or spatial arrangements resulting from the claims, the description or the drawings, may be essential to the invention individually or in the most various combinations.

REFERENCE NUMERALS

1 draw device
2 preparation device
3.1, 3.2 intake rollers
4 nozzle
5.1, 5.2 drafting system rollers
6.1, 6.2 drafting system rollers
7 nozzle
8 texturizing device
9 cooling drum
10.1, 10.2 drafting system rollers
11.1, 11.2 drafting system rollers
12 deflection
13 lapper
14 guide
F1 . . . Fn filaments
G1 . . . Gn yarn

The invention claimed is:

1. A draw device into which at least two individual filaments are guided for producing a multi-coloured yarn from differently coloured filaments, which consist of a plurality of endless filaments, comprising:

a pair of intake rollers for receiving the at least two individual filaments;

two pairs of drafting system rollers following the pair of intake rollers to draw the at least two individual filaments;

a texturizing device comprising a texturizing nozzle with a cooling drum disposed downstream of the two pairs of drafting system rollers for receiving the at least two individual filaments to form at least one texturized yarn in the texturizing nozzle; and at least one further nozzle to separately interlace each of the at least two individual filaments disposed downstream the two pairs of drafting system rollers and upstream of the texturizing device;

wherein the at least two individual filaments are drawn on at least one of the two pairs of drafting system rollers at a speed of at least 1,700 m/min.

2. The draw device according to claim 1 wherein the at least one further nozzle includes an additional nozzle disposed downstream the pair of intake rollers and upstream of the two pairs of drafting system rollers.

3. The draw device according to claim 1, wherein a gaseous medium at a pressure of 0.01 to 12 bars is blown into the at least one further nozzle.

4. The draw device according to claim 1, wherein one of the pairs of drafting system rollers is configured as duo rollers.

5. The draw device according to claim 1, further including a guide which guides each of the at least two individual filaments separately from each other, disposed upstream of the two pairs of drafting system rollers.

6. The draw device according claim 1, further including at least one further pair of drafting system rollers disposed downstream of the texturizing device with the cooling drum which cool-off the at least one yarn.

7. The draw device according to claim 6, wherein the at least one further pair of drafting system rollers cools the at least one yarn to a temperature of 0° C. to 80° C.

8. The device according to claim 1, wherein the at least two endless individual filaments are drawn on the pair of the two pairs of drafting system rollers which is directly disposed upstream of the texturizing nozzle at the speed of at least 1,700 m/min.

9. A method for producing a multi-coloured yarn from differently coloured filaments, which consist of at least two endless individual filaments, comprising:

guiding the at least two endless individual filaments into a draw device by a pair of intake rollers drawing the at least two endless individual filaments by at least two pairs of drafting system rollers following the pair of intake rollers, including drawing the at least two endless individual filaments on at least one of the at least two pairs of drafting system rollers at a speed of at least 1700 m/min;

subsequently texturizing the at least two endless individual filaments with a texturizing device comprising a texturizing nozzle to produce a texturized yarn and cooling the texturized yarn a cooling drum; and prior to the texturizing, and after the drawing the at least two endless individual filaments by the at least two pairs of drafting system rollers, respectively separately interlacing each of the at east two endless individual filaments with at least one further nozzle.

10. The method according to claim 9, further including additionally interlacing the at least two endless individual filaments prior to the drawing.

11. The method according to claim 9, including realizing the interlacing the of at least two endless individual filaments by a gaseous medium at a pressure of 0.01 to 12 bars.

12. The method according to claim 9, including, after the texturizing, cooling the yarn by at least one pair of drafting system rollers.

13. The method according to claim 12, wherein the cooling the yarn by at least one pair of drafting system rollers cools the yarn to a temperature of 0° C. to 80° C.

14. The method of claim 9, wherein the drawing the at least two endless individual filaments by the at least two pairs of drafting system rollers includes drawing the at least two endless individual filaments on the pair of the at least two pairs of drafting system rollers which is directly disposed upstream of the texturizing nozzle at the speed of at least 1,700 m/min.

* * * * *